US006827653B2

(12) United States Patent
Be

(10) Patent No.: US 6,827,653 B2
(45) Date of Patent: Dec. 7, 2004

(54) WRIST SUPPORT FOR BOWLERS

(76) Inventor: Sung-Hoan Be, 877-50 Kumdan-dong, Buk-Gu, Taegu (KR)

( * ) Notice: Subject to any disclaimer, the term of this patent is extended or adjusted under 35 U.S.C. 154(b) by 46 days.

(21) Appl. No.: 10/392,887

(22) Filed: Mar. 21, 2003

(65) Prior Publication Data

US 2004/0185950 A1 Sep. 23, 2004

(51) Int. Cl.[7] ..... A63B 69/00

(52) U.S. Cl. ..... 473/62; 473/61; 2/161.1; 2/162; 482/45; 602/16; 602/21

(58) Field of Search ..... 473/59, 61, 62, 473/63; 482/44, 45, 46, 47, 49, 50; 2/16, 20, 159, 160, 161.1, 161.2, 162, 163, 170; 602/5, 16, 21

(56) References Cited

U.S. PATENT DOCUMENTS 4,371,163 A * 2/1983 Shaffer et al. ..... 473/61
4,666,158 A * 5/1987 Moro ..... 473/62
4,925,187 A * 5/1990 Fleenor et al. ..... 473/62
5,163,678 A * 11/1992 Rogers ..... 473/59
5,466,192 A * 11/1995 Castolo et al. ..... 473/62
6,361,447 B1 * 3/2002 Lindstrom ..... 473/62

* cited by examiner

*Primary Examiner*—William M. Pierce
(74) *Attorney, Agent, or Firm*—Piper Rudnick LLP

(57) ABSTRACT

Disclosed herein is a wrist support for bowlers which prevents a user from being injured by shock applied to a user's wrist during bowling and which allows the user to accurately throw a bowling ball. The wrist support is designed to steplessly adjust horizontal and/or vertical angles between its hand back part, wrist part, and finger part, and is designed such that a fastening band unit is easily connected to and removed from a main body of the wrist part, and allows a user to feel comfortable when wearing the wrist support. The wrist support according to the present invention is designed such that click sounds are generated from the support when turning an adjusting knob provided at an angle adjusting part, thus allowing a user to confirm whether the angle adjusting part is operated or not, therefore providing reliability and convenience to a user. Further, the wrist support according to the present invention allows a user to easily connect a fastening band unit to the main body of the wrist part, thus the user rapidly putting on or taking off the wrist support. The wrist support is also designed to prevent an undesired removal thereof from the user's wrist, thus allowing the user to concentrate on a bowling game.

14 Claims, 12 Drawing Sheets

A

B

WRIST SUPPORT FOR BOWLERS

BACKGROUND OF THE INVENTION

1. Field of the Invention

The present invention relates generally to a wrist support for bowlers which prevents a user from being injured by shock applied to a user's wrist during bowling and which allows the user to accurately throw a bowling ball, and more particularly, to a wrist support for bowlers which is designed to steplessly adjust horizontal and/or vertical angles between its hand back part, wrist part, and finger part, and is designed such that a fastening band unit is easily connected to and removed from a main body of the wrist part, and allows a user to feel comfortable when wearing the wrist support.

2. Description of the Prior Art

As well known to those skilled in the art, a wrist support is an instrument which prevents a user's wrist and fingers from being injured by a heavy bowling ball during bowling, and allows a user to accurately throw the bowling ball, thus achieving excellent game results. There have been proposed a variety of kinds of wrist supports in the prior art.

Of these conventional wrist supports, a wrist support of the simplest type is designed such that its bottom surface is made of a sticky material, thus making it easy to handle a bowling ball. The wrist support also supports a user's wrist, thus preventing the user's wrist from being bent backward during bowling. Recently, a wrist support has been proposed which allows a user to adjust the angle of the wrist support as desired, thus making it easy to spin or hook a bowling ball.

As such, the angle-adjustable wrist support includes a hand back part, a wrist part, and an angle adjusting part. The hand back part is in close contact with a back of a user's hand, and the wrist part is in close contact with the wrist. The angle adjusting part connects the hand back part to the wrist part in such a way as to adjust a connecting angle between the wrist part and the hand back part in horizontal and vertical directions. In this case, the angle adjusting part is hinged to the wrist part by a connecting member. A screw-type or hook-type angle adjusting means is provided at the junction of the angle adjusting part and the wrist part.

The hook-type angle adjusting means includes a locking piece which is provided on the angle adjusting part and is operated by a spring. Two locking projections are provided at two predetermined portions on the lower surface of the locking piece. The locking projections removably engage with two of a plurality of locking holes which are formed on the hand back part at regular intervals.

That is, the vertical angle between the wrist part and the hand back part is adjusted according to the positions of the locking holes engaging with the locking projections formed on the lower surface of the locking piece. However, such a conventional angle-adjustable wrist support has a problem in that the locking projections of the locking piece are easily removed from the locking holes when the hand back part is bent backward. The wrist support has another problem in that an angle between the wrist part and the hand back part is adjusted by the fixed holes which are formed on the hand back part at regular intervals, so it is impossible to finely adjust the angle between the wrist part and the hand back part.

Further, there has been proposed another conventional wrist support, which is capable of somewhat finely adjusting an angle between the wrist part and the hand back part. The wrist support is designed such that a slip ring finely adjusts the angle between the wrist part and the hand back part through a slit formed on the center of an angle adjusting means, and the slip ring is easily removed from a locking piece provided on the hand back part, even when the support is being worn on a user's hand. Thus, the wrist support is advantageous in that the angle between the wrist part and the hand back part is finely adjusted. However, the conventional wrist support has a problem in that its construction is complicated, so its manufacturing cost is high.

Further, in the conventional wrist supports, the wrist part consists of a frame, a cushion, and a fastening band. The frame is made of a synthetic resin with appropriate strength. The cushion is made of a soft material, such as urethane foam, and is bonded to the frame. The fastening band is made of cloth or leather and is provided on a predetermined portion thereof with a fastening member, such as a Velcro fastener or a buckle, thus allowing a user to easily wear the wrist support.

However, when the fastening band fabricated with a Velcro fastener is used for a lengthy period of time, the fastening surfaces of two pieces of the Velcro fastener are deformed or abraded, so the fastening force becomes poor. In such a case, the fastening band may allow the wrist part to be easily unfastened from a user's wrist.

Meanwhile, the fastening band fabricated with a buckle consists of a leather or cloth band with a metal buckle, so its durability is excellent. However, a user must fasten opposite ends of the band to each other by inserting one end of the band into the buckle and buckling the ends of the band whenever the user wears the wrist support, so it is complicated and inconvenient to use.

SUMMARY OF THE INVENTION

Accordingly, the present invention has been made keeping in mind the above problems occurring in the prior art, and an object of the present invention is to provide a wrist support, comprising an angle adjusting part adjusting horizontal and vertical angles between a wrist part and a hand back part, an angle adjusting means for adjusting a horizontal angle between a finger part and a hand back frame, a click sound generating means for generating click sounds when operating the angle adjusting part, and a fastening means for easily fastening a fastening band unit to a main body of the wrist part when wearing the wrist part of the wrist support on a bowler's wrist.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
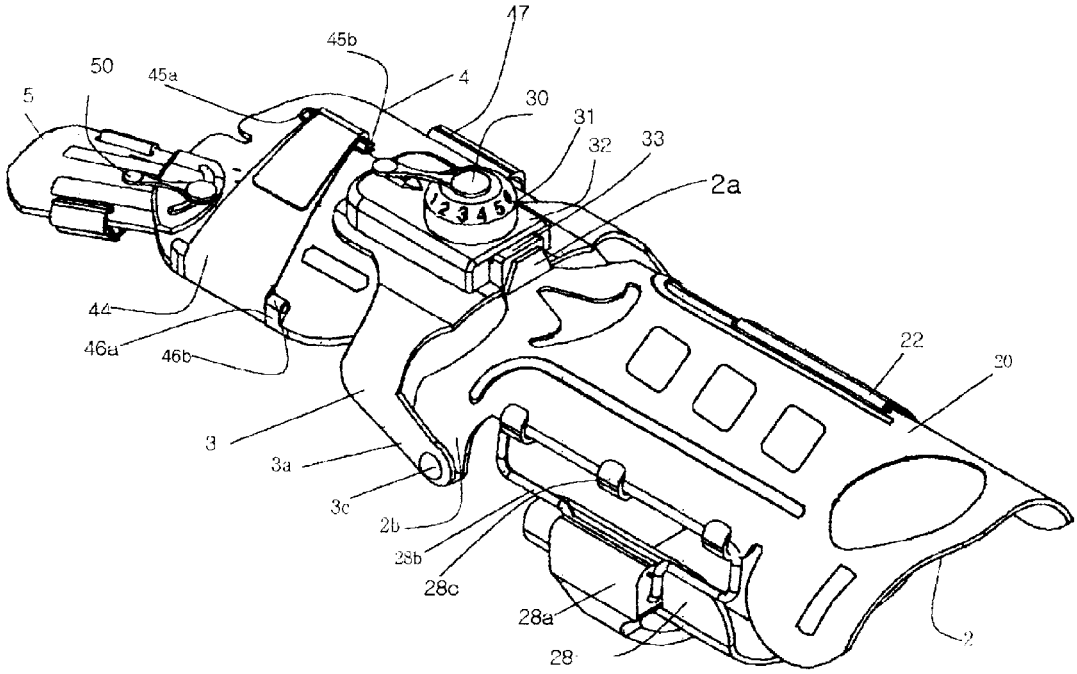
FIG. 1 is a perspective view showing a wrist support for bowlers according to a primary embodiment of the present invention.

Reference should now be made to the drawings, in which the same reference numerals are used throughout the different drawings to designate the same or similar components.

Figure 2:
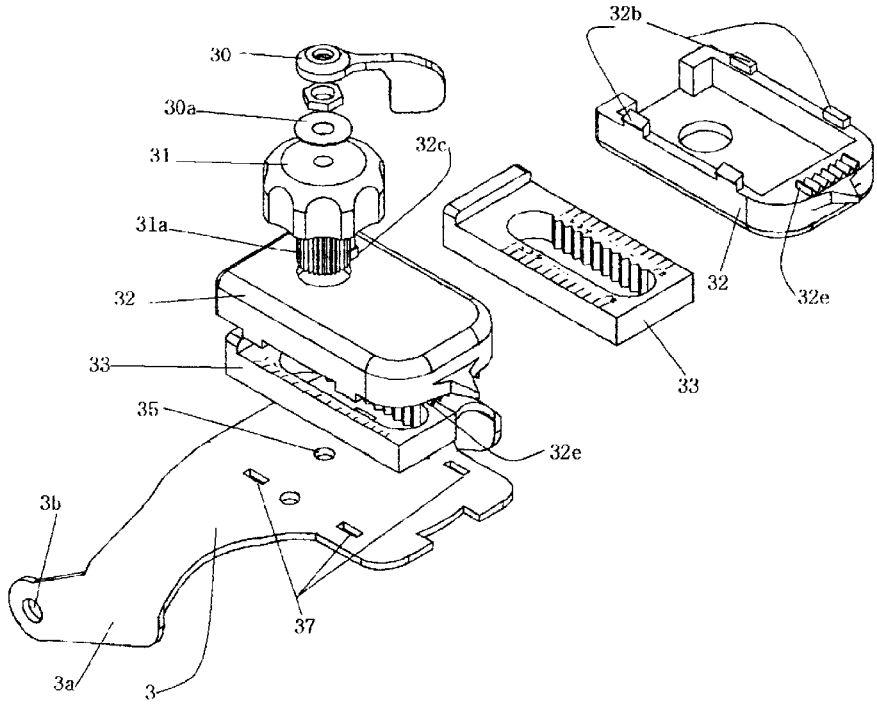
FIGS. 2 and 3 are exploded perspective views showing the wrist support according to the primary embodiment of the present invention.
Figure 3:
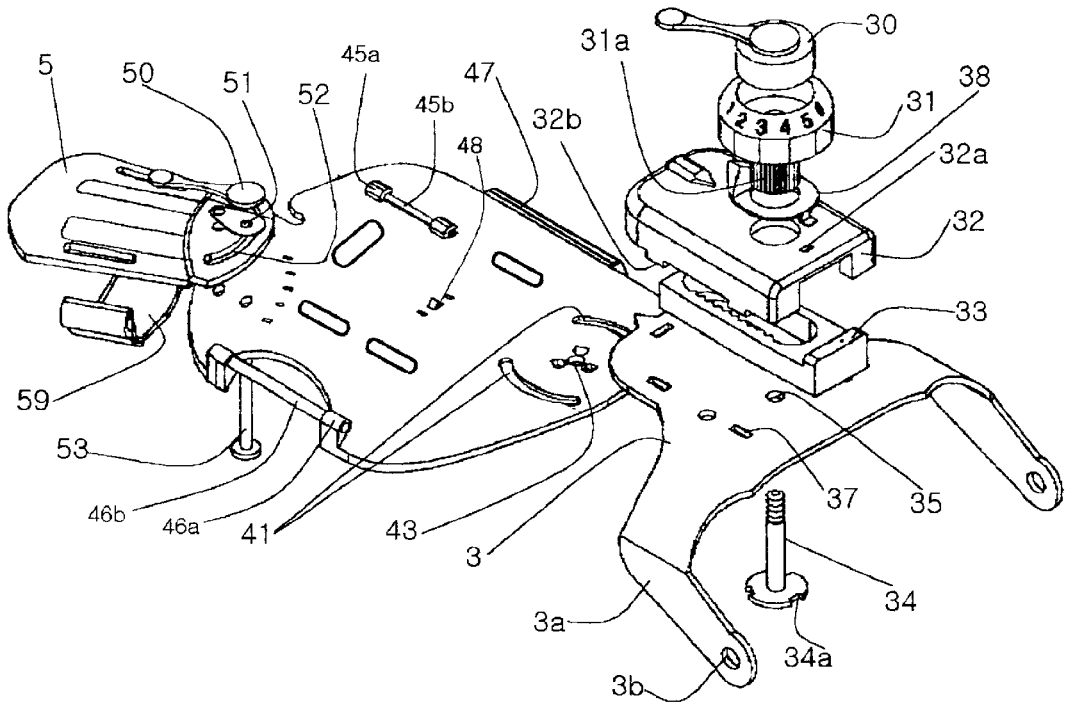

FIG. 1 is a perspective view showing a wrist support for bowlers according to a primary embodiment of the present invention. FIGS. 2 and 3 are exploded perspective views showing the wrist support according to the primary embodiment of the present invention.

As shown in FIGS. 1 to 3, the wrist support for supporting a user's wrist during bowling includes a wrist part 2, a hand back part 4, a finger part 5, and an angle adjusting part 3 provided between the hand back part 4 and the wrist part 2 for adjusting an angle between the hand back part 4 and the wrist part 2.

In this case, the hand back part 4 is provided at predetermined portions thereof with a first bolt fitting hole 43 and an angle adjusting protrusion 48. The angle adjusting part 3 consists of a second bolt fitting hole 35, cover fitting holes 37, an angle adjusting block 33, a cover 32, an angle adjusting knob 31, and a locker 30. The second bolt fitting hole 35 is formed on a predetermined portion of the angle adjusting part 3 for receiving a bolt 34, and the cover fitting holes 37 are formed at predetermined positions around the second bolt fitting hole 35. The adjusting block 33 is provided with a longitudinal opening having a rack gear. The cover 32 covers the adjusting block 33, and is provided on its lower edge with locking projections 32*b* and is provided on its central portion with a knob seating hole. The adjusting knob 31 has a third bolt fitting hole, a locker seating recess, and a pinion gear 31*a*. In this case, the pinion gear 31*a* is formed on the outer circumferential surface of the lower portion of the adjusting knob 31. The locker 30 is provided on its center with a vertical hole threaded on the lower portion of the inner surface thereof, and engages with the bolt 34 at the threaded part, with a washer 30*a* being interposed between the locker 30 and the locker seating recess of the adjusting knob 31. The locker 30 is also provided with a tightening handle.

The wrist part 2 comprises a longitudinal main body 20 and a fastening band unit. The main body 20 of the wrist part 2 is provided with a stopper 2*a* at its front end for stopping the adjusting block 33, with two front brackets 2*b* each having an angle adjusting part connecting hole formed at both corners of the front end of the main body 20. A first band holding slit 2*d* is provided at a side surface of the main body 20, while a second band holding slit 2*e* is provided on the main body 20 at the other side surface of the main body 20 opposite to the first band holding slit 2*d*. The fastening band unit comprises a frame 20*a* with a fastening means, and is inserted, at its both ends, into the band holding slits 2*d* and 2*e*.

Such a wrist support allows a vertical angle between the hand back part 4 and the wrist part 2 to be steplessly adjusted.

The angle adjusting part 3 consists of a frame made of a metal, and a cushion made of a synthetic resin. The angle adjusting part 3 is provided at its both sides with brackets 3*a* each having a wrist part connecting hole 3*b*. The wrist part 2 is rotatably connected to the angle adjusting part 3 through the wrist part connecting holes 3*b*. According to the present invention, the angle adjusting part 3 is hinged to the wrist part 2 in such a way as to be vertically rotatable about the connecting holes 3*b* for adjusting the angle between the hand back part 4 and the wrist part 2. At this time, the adjusting block 33 of the angle adjusting part 3 is stopped by the stopper 2*a* integrally provided at an end of the wrist part 2. The bolt fitting hole 35 and cover fitting holes 37 are formed on a base panel of the angle adjusting part 3. The adjusting block 33, the cover 32, the adjusting knob 31, and the locker 30 are sequentially set on the base panel of the angle adjusting part 3 and then fastened to the base panel by the bolt 34. When the adjusting knob 31 is rotated, resulting in a rotation of the pinion gear 31*a* provided on the outer circumferential surface of the lower portion of the adjusting knob 31, the adjusting block 33 with the rack gear moves rectilinearly. At this time, the adjusting block 33 is stopped by the stopper 2*a*, so the hand back part 4 is tilted up or down, thus adjusting a vertical angle between the wrist part 2 and the hand back part 4. That is, a user wears the wrist support, adjusts the angles of the support according to his body type as described above, and then locks the adjusted angles of wrist support by turning the locker 30.

In order to provide the structure for adjusting a horizontal angle between the hand back part 4 and the wrist part 2, two first arc-shaped holes 41 are formed at predetermined positions around the first bolt fitting hole 43 of the hand back part 4. First angle adjusting projections are provided on the lower surface of the angle adjusting part 3 around the second bolt fitting hole 35 in such a way as to be moved in opposite directions along the arc-shaped holes 41. In addition, an angle adjusting gear 32*e* is provided on an end of a lower surface of the cover 32.

That is, the angle adjusting projections are provided on the lower surface of the angle adjusting part 3 such that they are moved, in a horizontal direction, along the arc-shaped holes 41 provided at two positions around the bolt fitting hole 43, and adjust the horizontal angle of the two parts 2 and 4.

The angle adjusting projections may be separately manufactured and mounted to the base panel of the angle adjusting part 3. Preferably, the angle adjusting projections may be integrally formed on the angle adjusting part 3 by pressing the part 3, at predetermined positions, around the bolt fitting hole 43.

The angle adjusting protrusion 48 comprises a plate spring which is fitted into a spring seating hole formed at a predetermined portion of the hand back part 4, and is designed to movably engage with the angle adjusting gear 32*e* provided on the lower end of the cover 32.

As such, the angle adjusting part 3, the adjusting block 33, the cover 32, the adjusting knob 31, and the locker 30 are sequentially placed on the hand back part 4, and are fastened to the hand back part 4 by tightening the bolt 24 from the lower surface of the hand back part 4. As the angle adjusting projections are moved along the arc-shaped holes 41, the hand back part 4 is rotated around the bolt 34. The horizontal angle between the hand back part 4 and the wrist part 2 is thus adjusted. When the angle adjusting projections are moved along the arc-shaped holes 41, the angle adjusting protrusion 48, movably engaging with the angle adjusting gear 32*e*, generates click sound, and the angle between the hand back part 4 and the wrist part 2 is stepwisely adjusted.

The wrist support of the present invention also has a first connecting hole (not shown) and a second angle adjusting projection (not shown), a second connecting hole (not shown), and a second arc-shaped hole 52, a threaded locker 50, and a rivet 53 so as to steplessly adjust the angle between the finger part 5 and the hand back part 4. The first connecting hole and the second angle adjusting projection are provided on predetermined portions of the hand back part 4. The second connecting hole and the second arc-shaped hole 52 are provided on predetermined portions of the finger part 5. The threaded locker 50 connects the finger part 5 to the hand back part 4 through a fastening method using nut and bolt, and adjusts an angle between the hand back part 4 and the finger part 5.

First, the first connecting hole is formed on a predetermined portion of the hand back part 4 and the angle adjusting projection is formed on the hand back part 4 in a manner similar to the angle adjusting projections of the angle adjusting part 3. Meanwhile, the arc-shaped hole 52 is formed on a predetermined portion of the finger part 5 in such a way that the angle adjusting projection is inserted into and moved in opposite directions along the arc-shaped hole 52. The second connecting hole is formed on the finger part 5 to connect the hand back part 4 to the finger part 5. The locker 50, having a washer 51 and a nut, is mounted to the finger part 5 by the rivet 53 from the lower surface of the hand back part 4. Further, the finger part 5 is provided with a finger band 59 for holding a user's finger in a desired position, thus allowing the user to perform a variety of bowling techniques, such as hook throw or straight throw, during bowling.

The bolt 34 is provided on its head with a plurality of internal teeth 34*a*. The second bolt fitting hole 43 of the hand back part 4 positioned below the angle adjusting part 3 is provided along its inner circumferential surface with a plurality of external teeth (not shown). The bolt 34 is fitted into the bolt fitting hole 43 in such a way that the internal teeth 34*a* of the bolt 34 engage with the external teeth of the bolt fitting hole 43. Thus, the bolt 34 is locked to the angle adjusting part 3.

Figure 4:
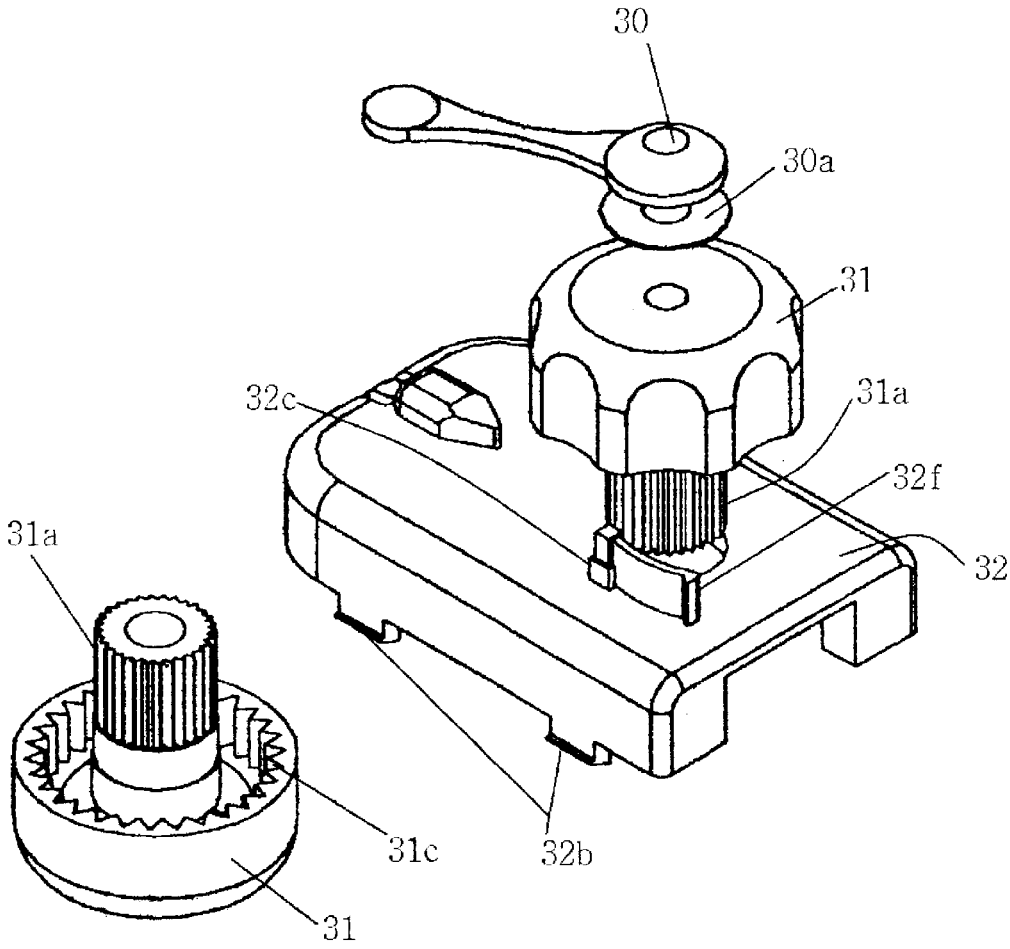
FIGS. 4 to 6 are perspective views of click sound generating units of the wrist support according to three different embodiments of the present invention.
Figure 6:
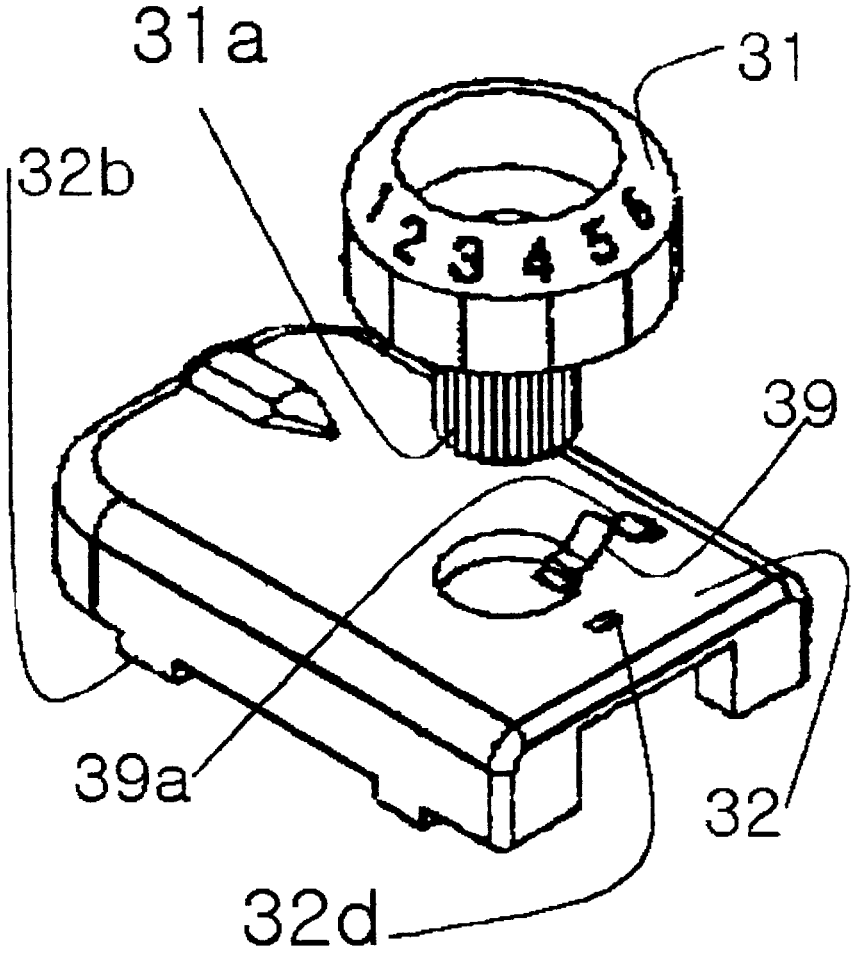

FIGS. 4 and 6 are perspective views of click sound generating units of the wrist support according to three different embodiments of the present invention.

As shown in FIG. 4, a lever 32*f* for creating a click sound engages with internal teeth 31*c* provided on the inner circumferential surface of the adjusting knob 31 in such a way as to generate click sounds when turning the adjusting knob 31. The lever 32*f* is supported by a housing 32*c* which is provided at a position adjacent to the adjusting knob 31 in such a way as to be integrated with the cover 32 into a single structure.

Figure 5:
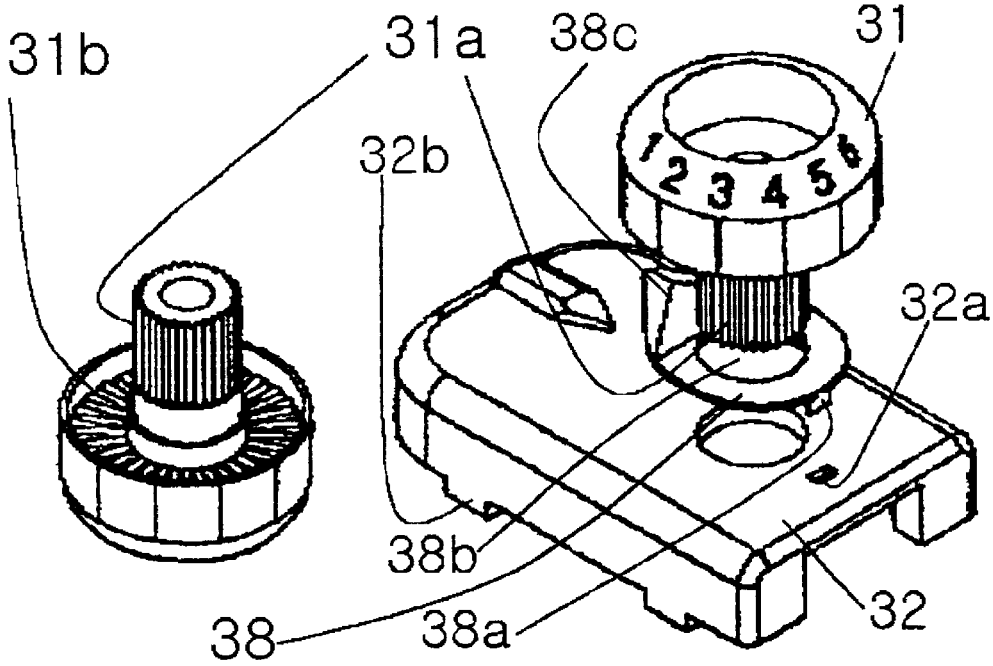

As shown in FIG. 5, a plate spring 38, having a knob fitting hole 38*b*, a first bracket 38*a*, and a lug 38*c* for creating sound, is interposed between the adjusting knob 31 and the upper surface of the cover 32 in such a way as to generate click sounds when turning the adjusting knob 31. The adjusting knob 31 is provided on a lower surface of its knob body with a plurality of teeth 31*b*, and the cover 32 is provided with a bracket fitting hole 32*a* for receiving the bracket 38*a* of the plate spring 38.

When the locker 30 and the bolt 34 are tightened, a tightening force is applied to the adjusting knob 31, so the lug 38*c* upwardly bent from the plate spring 38 is in elastic contact with the teeth 31*b* formed on the lower surface of the adjusting knob 31. When the adjusting knob 31 is turned so as to adjust the angle between the wrist part 2 and the hand back part 4, the teeth 31*b* of the adjusting knob 31 pass over the lug 38*c* of the plate spring 38. At this time, click sounds are generated from the lug 38*c* and the teeth 31*b*.

According to another embodiment, a U-shaped spring 39, which is provided on a portion thereof with a second bracket 39*a*, is fitted into a bracket fitting hole 32*d* formed on the cover 32 in such a way as to engage with the teeth 31*b* of the adjusting knob 31 in order to generate click sounds when turning the adjusting knob 31, as shown in FIG. 6.

The bracket fitting hole 32*d* for receiving the bracket 39*a* of the U-shaped spring 39 is horizontally formed at a predetermined portion of the cover 32. The bracket 39*a* of the U-shaped spring 39 is fitted into the fitting hole 32*d*, and the angle adjusting part 3 is installed in its place. At this time, when turning the adjusting knob 31 to adjust the angle between the wrist part 2 and the hand back part 4, the teeth 31*b* formed on the lower surface of the knob body of the adjusting knob 31 and brought into elastic contact with the U-shaped spring 39 are moved over the spring 39, thus generating click sounds.

Figure 7:
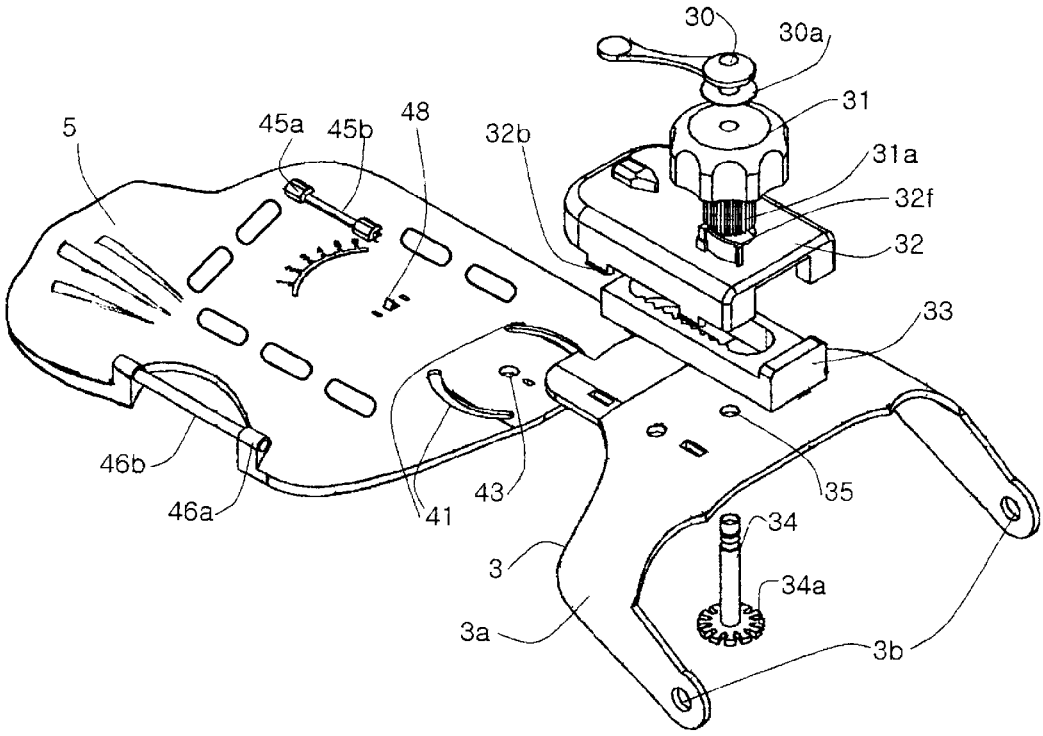
FIG. 7 is an exploded perspective view showing a wrist support for bowlers according to a second embodiment of the present invention, in which a finger part is integrated with a hand back part to form a single structure.
Figure 8:
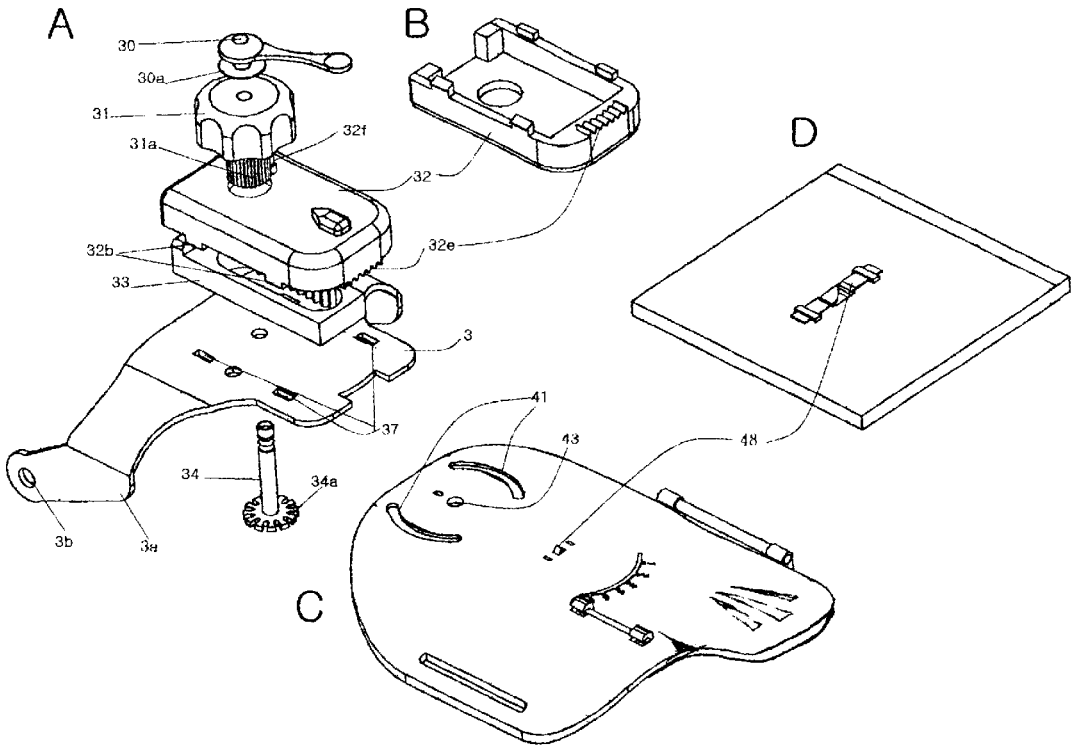
FIG. 8 is an exploded perspective view of the wrist support according to the second embodiment of the present invention, showing an angle adjusting protrusion and an angle adjusting gear.

Preferably, the finger part 5 may be integrated with the hand back part 4 without affecting the functioning of the present invention, as shown in FIGS. 7 and 8.

As described above, the wrist part 2 of the wrist support consists of a longitudinal main body 20 and a fastening band unit. The main body 20 of the wrist part 2 is provided with the stopper 2*a* at its front end for stopping the adjusting block 33. Two front brackets 2*b* each having an angle adjusting part connecting hole are formed at both corners of the front end of the main body 20 so as to hinge the main body 20 to the brackets 3*a* of the angle adjusting part 3. In addition, the first band holding slit 2*d* is provided at a side surface of the main body 20, while the second band holding slit 2*e* is provided on the main body 20 at the other side surface of the main body 20 opposite to the first band holding slit 2*d*. The fastening band unit comprises the frame 20*a* with a fastening means, and is inserted, at its both ends, into the band holding slits 2*d* and 2*e*.

The construction of the fastening band units according to the three different embodiments of the present invention will be described in detail herein below, with reference to FIGS. 9A, 9B, 10 and 11.

Figure 9:
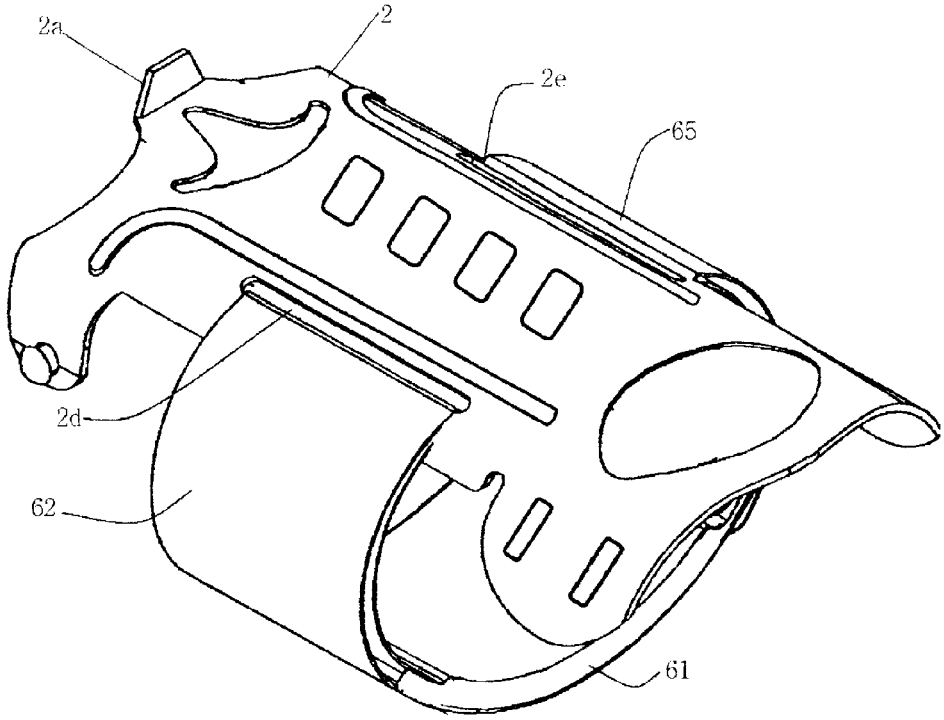
FIGS. 9A, 9B, 10 and 11 are perspective views showing fastening band units according to three different embodiments of the present invention.
Figure 9:
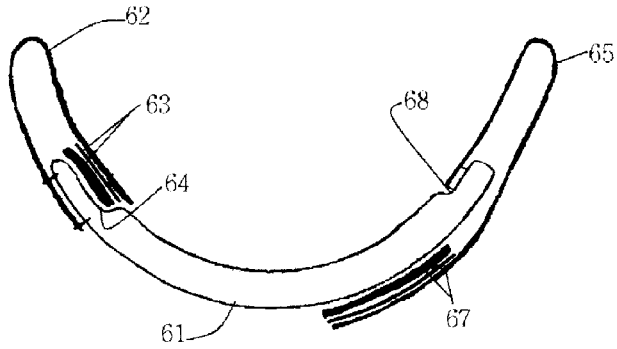

According to an embodiment shown in FIGS. 9A and 9B, a Velcro fastener is attached to the fastening band unit. However, when wearing the fastening band unit having a Velcro fastener, a projecting part may be undesirably formed on the fastening band unit, thus causing a user discomfort. Thus, in order to solve such a problem, first and second steps 64 and 68 are formed on both ends of a frame 61. Hook and pile pieces of a Velcro fastener 63 are sewn on an inner surface of the first step 64 and an end of a connecting band 62, respectively, and the other end of the connecting band 62 is sewn on the outer surface of the end having the first step 64. Further, an end of a fastening band 65 is sewn on an inner surface of the second step 68 and hook and pile pieces of another Velcro fastener 67 are sewn on an outer surface of the end having the second step 68 and the other end of the fastening band 65, respectively. When it is desired to wear the wrist part 2 of the wrist support on a user's wrist, the user inserts the connecting and fastening bands 62 and 65 into the band holding slits 2*d* and 2*e*, respectively, and appropriately adjusts the lengths of the connecting and fastening bands 62 and 65 such that the wrist part 2 is closely fitted around the wrist of the user, and the user fastens the fastening and connecting bands 62 and 65 to the frame 61 using the Velcro fasteners 63 and 67, respectively.

Figure 10:
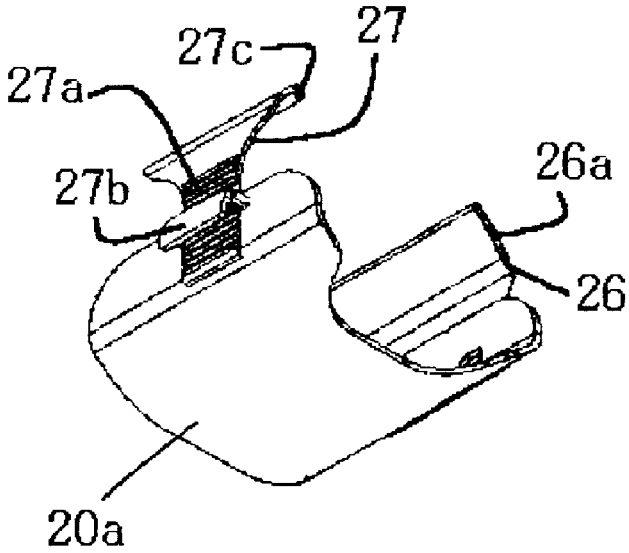

According to another embodiment of FIG. 10, the fastening band unit of the wrist part 2 includes a frame 20*a*, a connecting band 26, and a fastening band 27. The connecting band 26, hinged to one end of the frame 20*a* and provided with a shaft hole 26*a*, is hinged at the shaft hole 26*a* to a bracket-shaped first band holder (not shown) of the main body 20 by using a hinge shaft. The fastening band 27, provided at a first end thereof with a shaft hole 27*c* and at a second end thereof with a corrugated surface 27*a*, is adjustably fastened at the corrugated surface 27*a* to a locking lever 27*b* which is provided at the other end of the frame 20*a*. The shaft hole 27*c* of the fastening band 27 is hinged to a bracket-shaped second band holder (not shown) of the main body 20 by using a hinge shaft (not shown).

In the embodiment of FIG. 10, a locking means, which has been frequently used in inline skates, is applied to the wrist part 2. When it is desired to wear the wrist part 2 of the wrist support on a user's wrist, the end of the fastening band 27 having the corrugated surface 27*a* is released and removed from the locking lever 27*b* of the frame 20*a* prior to positioning the wrist part 2 around the user's wrist. After positioning the wrist part 2 around the user's wrist, the end of the fastening band 27 having the corrugated surface 27*a* is inserted into the gap between the opened locking lever 27*b* and the frame 20*a* until the wrist part 2 fits closely around the user's wrist, and, thereafter, the locking lever 27*b* of the frame 20*a* is operated to stop the corrugated surface 27*a* of the fastening band 27. Therefore, the wrist part 2 of the wrist support fits closely around the user's wrist.

Figure 11:
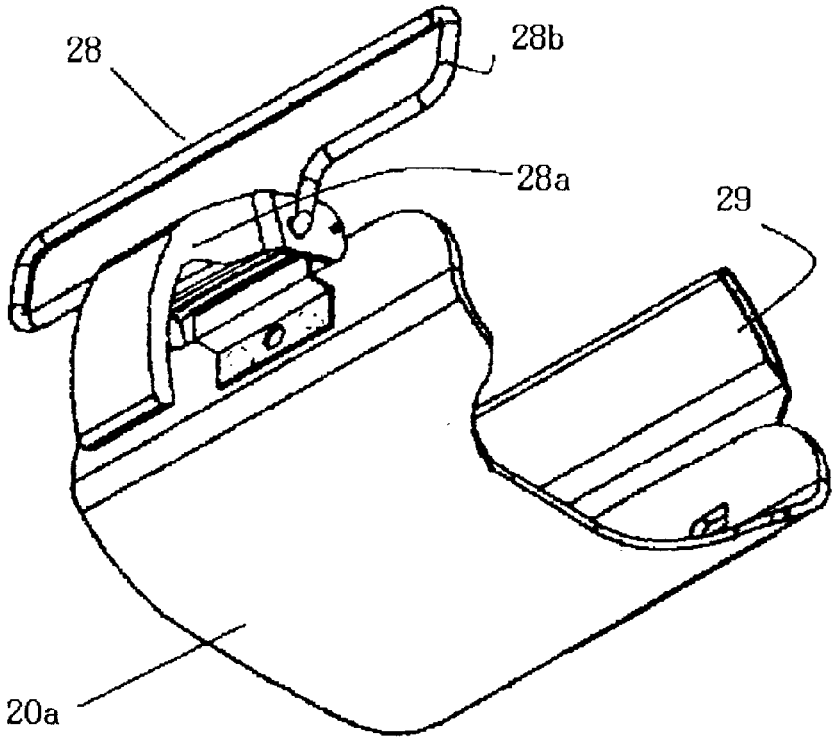

As shown in FIG. 11 showing a further embodiment of the present invention, the fastening band unit of the wrist part 2 includes a frame 20*a* which is provided at a first end thereof with a Velcro fastener 29 and at a second end thereof with a locking unit 28. The locking unit 28 comprises a locking lever 28*a* and a locking loop 28*b*. The first end of the fastening band unit having the Velcro fastener 29 is fastened to a bracket-shaped first band holder 22 of the main body 20. The locking unit 28, provided at the second end of the frame 20*a*, is fastened to a hook-shaped second band holder 28*c* which is provided on the main body 20 of the wrist part 2 at a position opposed to the bracket-shaped first band holder 22 as shown in FIG. 1. When it is desired to wear the wrist part 2 around a user's wrist, the locking loop 28*b* of the locking unit 28 of the fastening band unit is caught by the hook-shaped second band holder 28*c* of the main body 20, prior to operating the locking lever 28*a* to fasten the locking unit 28 to the hook-shaped second band holder 28*c* of the main body 20. The first end of the fastening band unit having the Velcro fastener 29 is inserted into the gap between the external surface of the main body 20 and the hinge shaft provided at the bracket-shaped first band holder 22 of the main body 20, and is wrapped around the hinge shaft. Thereafter, the first end of the fastening band unit is adjusted in its length according to the size of the user's wrist, and the hook and pile pieces of the Velcro fastener 29 are pressed together to interlock, thus allowing the wrist part 2 of the wrist support to be closely worn around the user's wrist.

Figure 12:
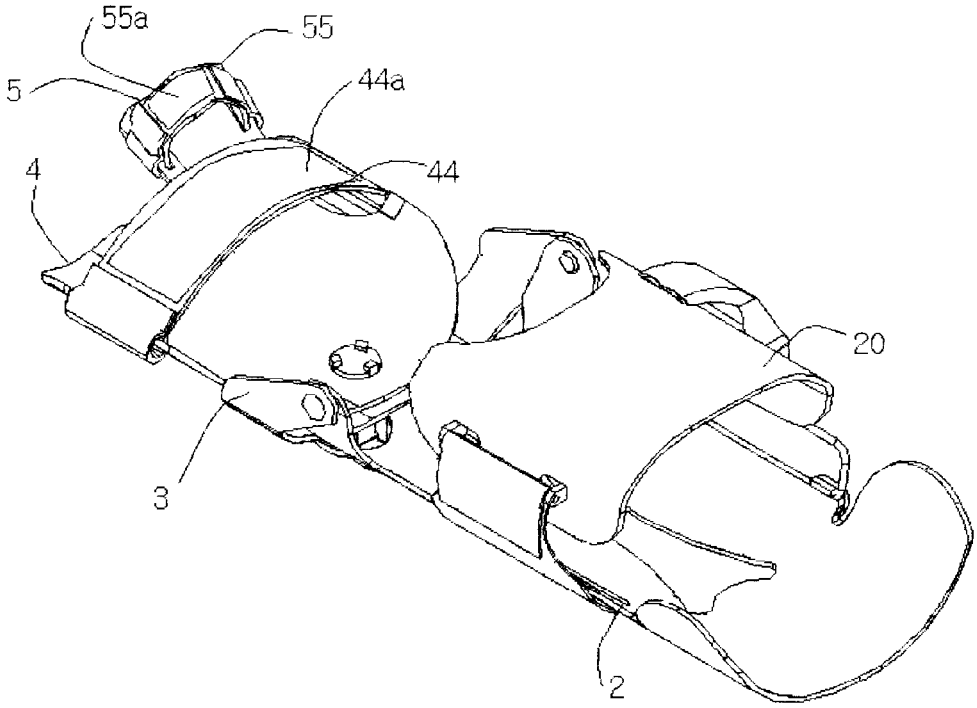
FIG. 12 is a bottom perspective view showing anti-slip sheets included in the wrist support according to the present invention.

Further, the wrist support of the present invention includes a hand fastening band 44 and a finger fastening band 551 as shown in FIG. 12.

The hand fastening band 44 is fastened at a first end thereof to a first connecting bracket 45*a* of the hand back part 4 of the wrist support by a first pin 45*b*, and is connected at a second end thereof to a tightening bracket 47 of the hand back part 4 after passing over a second pin 46*b* provided at a second connecting bracket 46*a* of the hand back part 4, thus fastening the hand back part 4 to a user's hand. The finger fastening band 55 is provided at the finger part 5 of the wrist support, and fastens the finger part 5 to a user's finger.

Two anti-slip sheets 44*a* and 55*a* are provided on the outside surfaces of the hand fastening band 44 and the finger fastening band 55, respectively, in the method of seaming, bonding or coating, thus allowing a user to easily catch a bowling ball and preventing the bowling ball from unexpectedly slipping from the user's hand when releasing the bowling ball on a bowling lane. The anti-slip sheets 44*a* and 55*a* are preferably made of a rubber or a synthetic resin.

As described above, the present invention provides a wrist support, which is advantageous as follows.

A user, wearing the wrist support around his/her wrist, is allowed to easily adjust vertical and horizontal angles between a wrist part and a hand back part of the support, in addition to steplessly adjusting an angle between a finger part and the hand back part of the support. The wrist support thus makes it convenient to adjust the angles between the wrist part and the hand back part, and between the finger part and the hand back part, and so it is easy to adjust the angles of the wrist support as desired.

The wrist support according to the present invention is designed such that click sounds are generated from the support when turning an adjusting knob provided at an angle adjusting part, thus allowing a user to confirm whether the angle adjusting part is operated or not, therefore providing reliability and convenience to a user.

Further, the wrist support according to the present invention allows a user to easily connect a fastening band unit to the main body of the wrist part, thus the user rapidly putting on or taking off the wrist support. The wrist support is also designed to prevent an undesired removal thereof from the user's wrist, thus allowing the user to concentrate on a bowling game.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A wrist support for supporting a user's wrist during bowling, said wrist support comprising a wrist part, a hand back part, a finger part, an angle adjusting part provided between the hand back part and the wrist part for adjusting an angle between the hand back part and the wrist part, wherein said hand back part is provided at a predetermined portion thereof with a first bolt fitting hole and an angle adjusting protrusion;

said angle adjusting part comprises:

a second bolt fitting hole formed on a predetermined portion of the angle adjusting part for receiving a bolt, and a plurality of cover fitting holes formed at predetermined positions around the second bolt fitting hole;

an adjusting block provided with a longitudinal opening having a rack gear;

a cover for covering the adjusting block, said cover provided on a lower edge thereof with a plurality of locking projections and provided on a central portion thereof with a knob seating hole;

an adjusting knob having:

a third bolt fitting hole;

a locker seating recess; and a pinion gear provided on an outer circumferential surface of a lower portion of the adjusting knob; and a locker provided on a lower end thereof with an internally threaded hole to engage with said bolt at said internally threaded hole, and provided with a tightening handle; and said wrist part comprises:

a longitudinal main body having:

a stopper provided at a front end of the main body for stopping the adjusting block;

two front brackets each having an angle adjusting part connecting hole and formed at both corners of the front end of said main body so as to hinge the main body to brackets of said angle adjusting part using locking bolts;

a first band holding slit provided at a side surface of the main body; and a second band holding slit provided on the main body at a position opposite to the first band holding slit; and a fastening band unit comprising a frame with fastening means, and inserted at both ends thereof into the first and second band holding slits of the main body, respectively, thus allowing the wrist part to fit closely around the user's wrist, whereby a vertical angle between the hand back part and the wrist part is steplessly adjusted.

2. The wrist support according to claim 1, wherein two first arc-shaped holes are formed at predetermined positions around the first bolt fitting hole of the hand back part, and first angle adjusting projections are provided on a lower surface of the angle adjusting part around the second bolt fitting hole in such a way as to be moved in opposite directions along said first arc-shaped holes, and an angle adjusting gear is provided at an end of the cover of the angle adjusting part, whereby a horizontal angle between the hand back part and the wrist part is adjusted.

3. The wrist support according to claim 1, further comprising:

a first connecting hole and a second angle adjusting projection provided on predetermined portions of the hand back part;

a second connecting hole and a second arc-shaped hole provided on predetermined portions of the finger part;

a threaded locker for connecting the hand back part to the finger part through a fastening method using nut and bolt and adjusting an angle between the hand back part and the finger part; and a rivet, whereby the angle between the finger part and the hand back part is steplessly adjusted.

4. The wrist support according to claim 1, wherein said bolt is provided on a head thereof with a plurality of internal teeth, and said first bolt fitting hole of the hand back part positioned below the angle adjusting part is provided along an inner circumferential surface thereof with a plurality of external teeth.

5. The wrist support according to claim 1, wherein a lever for creating a click sound engages with internal teeth provided on an inner circumferential surface of the adjusting knob in such a way as to generate a click sound when turning the adjusting knob, said lever being supported by a housing which is provided at a position adjacent to the adjusting knob in such a way as to be integrated with the cover of the angle adjusting part.

6. The wrist support according to claim 1, wherein a plate spring, including a knob fitting hole, a first bracket, and a lug for making sound, is interposed between the adjusting knob and the cover in such a way as to generate click sounds when turning the adjusting knob, said adjusting knob provided on a lower surface thereof with a plurality of teeth for engaging with the lug of the plate spring, said cover provided with a fitting hole for receiving the plate spring.

7. The wrist support according to claim 1, wherein a U-shaped spring, provided on a portion thereof with a second bracket, is fitted into a fitting hole formed on said cover in such a way as to engage with a plurality of teeth of the adjusting knob for generating click sounds when turning the adjusting knob.

8. The wrist support according to claim 1, wherein said fastening band unit comprises:

a connecting band inserted into a first band holding slit formed on the main body and having a first Velcro fastener, two pieces of said first Velcro fastener being sewn on an inner surface of a first step formed on a first end of the frame and a first end of the connecting band, respectively, while a second end of the connecting band being sewn on an outer surface of the first end of the frame having the first step;

a fastening band inserted into a second band holding slit which is formed on the main body at a position opposite to the first band holding slit and having a second Velcro fastener, a first end of said fastening band being sewn on an inner surface of a second step formed on a second end of the frame while two pieces of said Velcro fastener are sewn on an outer surface of the second end of the frame having the second step and a second end of the fastening band, respectively.

9. The wrist support according to claim 1, wherein said fastening band unit comprises:

a frame having a locking lever at a first end thereof;

a connecting band hinged to a second end of said frame and provided with a shaft hole, said connecting band being hinged at said shaft hole to the first band holder of the main body of said wrist part by using a hinge shaft; and a fastening band provided at a first end thereof with a shaft hole and at a second end thereof with a corrugated surface, said fastening band being adjustably fastened at the corrugated surface to the locking lever of said frame, and hinged at said shaft hole to the second band holder of the main body of said wrist part by using a hinge shaft.

10. The wrist support according to claim 1, wherein said fastening band unit comprises:

a frame provided at a first end thereof with a Velcro fastener and at a second end thereof with a locking unit, said locking unit comprising a locking lever and a locking loop, whereby said first end of the fastening band unit having the Velcro fastener is fastened to a bracket-shaped first band holder of the main body of said wrist part by using a hinge shaft, and said locking unit is fastened at the locking loop thereof to a hook-shaped second band holder of the main body of the wrist part.

11. The wrist support according to claim 1, further comprises:

a hand fastening band fastened at a first end thereof to a first connecting bracket of said hand back part by a first pin, and connected at a second end thereof to a tightening bracket of the hand back part after passing over a second pin provided at a second connecting bracket of the hand back part, thus fastening the hand back part to a user's hand;

a finger fastening band provided at said finger part for fastening the finger part to a user's finger; and an anti-slip sheet provided on an outside surface of each of the hand fastening band and the finger fastening band so as to increase an adhesive force of each of the fastening bands relative to a bowling ball, said anti-slip sheet being made of rubber or synthetic resin.

12. The wrist support according to claim 2, further comprising:

a first connecting hole and a second angle adjusting projection provided on predetermined portions of the hand back part;

a second connecting hole and a second arc-shaped hole provided on predetermined portions of the finger part;

a threaded locker for connecting the hand back part to the finger part through a fastening method using nut and bolt and adjusting an angle between the hand back part and the finger part; and a rivet, whereby the angle between the finger part and the hand back part is steplessly adjusted.

13. The wrist support according to claim 2, wherein said bolt is provided on a head thereof with a plurality of internal teeth, and said first bolt fitting hole of the hand back part positioned below the angle adjusting part is provided along an inner circumferential surface thereof with a plurality of external teeth.

14. The wrist support according to claim 3, wherein said bolt is provided on a head thereof with a plurality of internal teeth, and said first bolt fitting hole of the hand back part positioned below the angle adjusting part is provided along an inner circumferential surface thereof with a plurality of external teeth.

* * * * *